United States Patent [19]

Champagne et al.

[11] Patent Number: 4,646,501

[45] Date of Patent: Mar. 3, 1987

[54] STARTER BRACKET FOR INSTALLING ALUMINUM SIDING

[75] Inventors: Charles A. Champagne; Wendel J. Champagne, both of Tomball, Tex.

[73] Assignee: CHW Enterprises, Inc., Tomball, Tex.

[21] Appl. No.: 821,241

[22] Filed: Jan. 22, 1986

Related U.S. Application Data

[63] Continuation-in-part of Ser. No. 701,694, Feb. 14, 1985.

[51] Int. Cl.[4] ..... E04D 1/00

[52] U.S. Cl. ..... 52/520; 52/545

[58] Field of Search ..... 52/518, 519, 545, 551, 52/520–522, 543, 552; 428/595, 99, 100, 130, 137, 138

[56] References Cited

U.S. PATENT DOCUMENTS

| | | | |
|---|---|---|---|
| 4,079,562 | 3/1978 | Englert | 52/545 |
| 4,272,576 | 6/1981 | Britson | 52/545 X |
| 4,288,958 | 9/1981 | Chalmers et al. | 52/551 X |
| 4,348,849 | 9/1982 | Wollam et al. | 52/545 |
| 4,424,655 | 1/1984 | Trostle | 52/545 X |

*Primary Examiner*—Carl D. Friedman
*Assistant Examiner*—Naoko N. Slack
*Attorney, Agent, or Firm*—Browning, Bushman, Zamecki & Anderson

[57] ABSTRACT

A bracket for installing panels, such as aluminum siding, is formed by an elongated member having a cross section providing great rigidity and a cross bar section having a profile for engaging a bottom marginal channel of a panel member. The bracket can either be first mounted on the sructure and the panel received thereon or it can be mounted in the panel and then fixedly attached to the structure to secure the panel thereto.

10 Claims, 3 Drawing Figures

STARTER BRACKET FOR INSTALLING ALUMINUM SIDING

CROSS REFERENCE TO RELATED APPLICATION

The present application is a continuation-in-part of our application Ser. No. 701,694 filed Feb. 14, 1985.

BACKGROUND OF THE INVENTION

1. Field of the Invention

The present invention relates to a bracket for use in installing the first, starter or bottom row of preformed siding, such as aluminum siding usually used to clad the exterior of a building.

2. Description of the Prior Art

One of the most popular building materials at this time is preformed aluminum siding. This siding is extruded or formed in 12 foot panels and in 8 or 10 inch widths and is profiled to simulate two lapped pieces of siding. The panels may have a wide variety of finishes ranging from a smooth surface to a textured finish simulating wood or other desirable grainings. The siding is then coated with a material providing the desired coloring as well as added finish features.

Siding of the above type has conventionally been installed by one of two methods. In one method, an extruded or pre-formed member is fixedly attached extending horizontally near the bottom edge of the wall to be covered. This member must be fairly accurately positioned since it will be the base upon which the remaining members are mounted. Any inaccuracy in level or alignment of this member will result in an unsightly appearance for the remainder of the wall. It is therefore very important that this member be accurately positioned. Because it is low to the ground in most instances, it is very difficult to install accurately. The first row of siding is then attached to the member and nailed to the wall with each succeeding row hooked to the row beneath it and likewise secured to the wall. Another conventional installation method uses wood stripes, such as cedar shakes or plywood, cut to length to extend approximately 2–4 inches above the standard 8 or 10 inch width siding. The wood strips are then slipped behind the siding to engage in the bottom groove and extend above the top edge of the panel. The wood strips are spaced approximately 6–12 inches apart along the length of the panel and then are nailed to the wall, with the appropriate leveling taking place. While this provides for a rather economical and easy installation, it does have the disadvantages in that the wood is subject to rot and/or attack by bugs and therefore has a limited life. This also has the disadvantage in that it does not provide a complete and fixed rigid installation at the base of a wall which may be highly desirable in locations where the structure would be subject to frequent or periodic high winds or wind gusts.

Another disadvantage of known installation methods and devices is they are limited in where they can be mounted. For example, any building may have a foundation which is not precisely horizontal. There may be joints or unevenness caused by settling or heaving. The prior art methods and devices for mounting sliding panels would not accommodate for this. An arbitrary horizontal starting line would have to be established and this could cause either mounting the starter in the block or concrete foundation or gaps showing below the bottom panel or both.

Finally, many of the known mounting means and methods are not suitable for mounting panels on other parts of the building, for example the peaks or soffet, or for decorative patterning, such as a chevron pattern.

SUMMARY OF THE INVENTION

The present invention is intended to overcome the above discussed deficiencies of the prior art by providing a bracket for fixedly attaching preformed panels to a structure. The present invention utilizes a plurality of starter brackets, each bracket comprising a pair of formed members fixed together in a "T" configuration. The normally vertically extending member has a profiled cross section designed to provide great rigidity to the bracket. The member is preferably 2–4 inches longer than the width of the panel to be mounted thereby. This member may also be provided with an array of mounting apertures. The cross bar member is profiled to be received in tight fitting relation to the bottom mounting groove of panel to be mounted. The two members are jointed together in a fixed configuration by any known means, such as aluminum rivets.

BRIEF DESCRIPTION OF THE DRAWINGS

The present invention will now be described by way of example with reference to the accompanying drawings in which.

DETAILED DESCRIPTION OF THE PRESENT INVENTION

Figure 1:
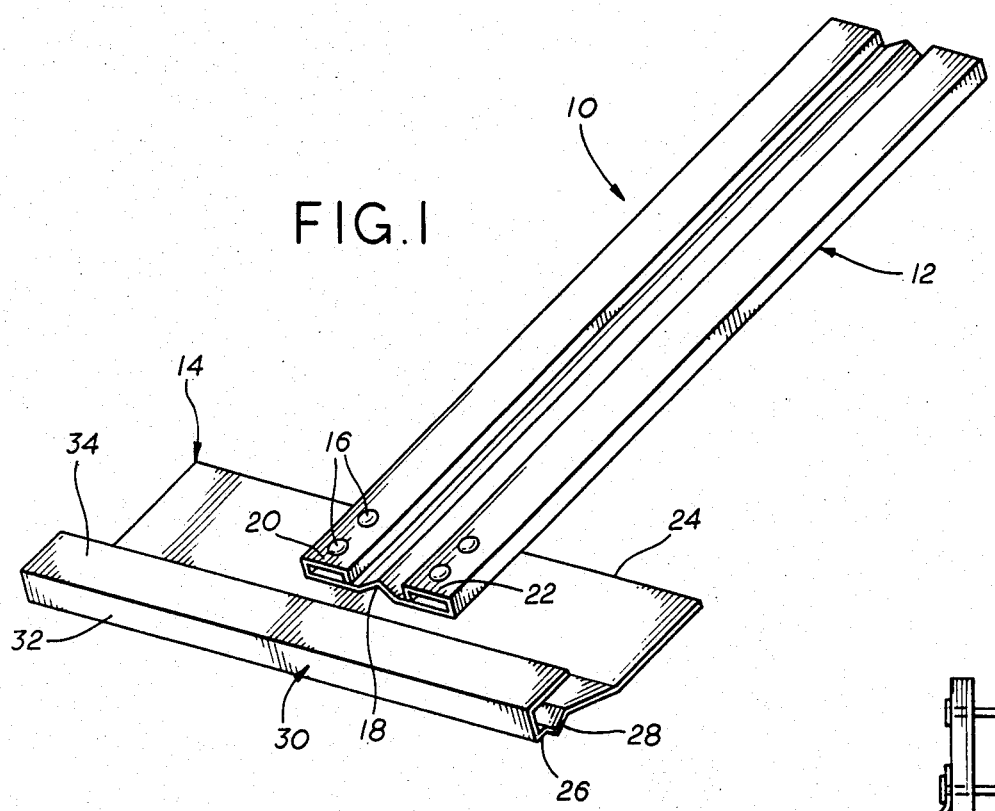
FIG. 1 is a perspective view of a mounting bracket according to the present invention.
Figure 2:
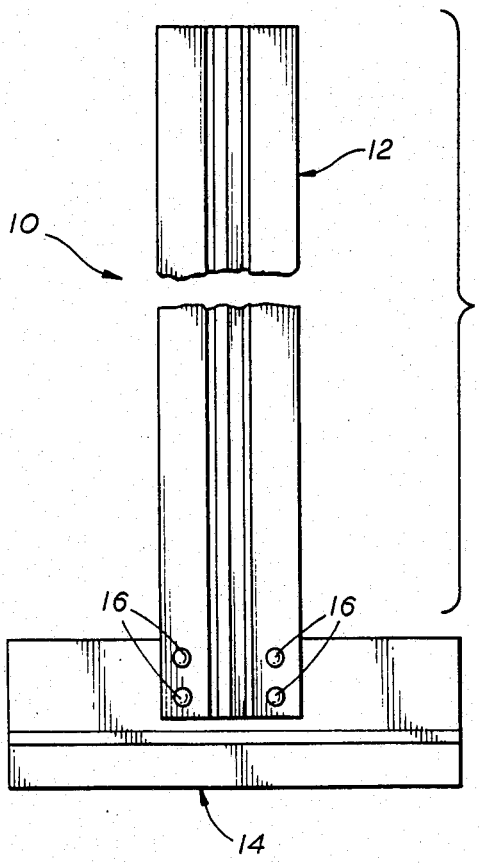
FIG. 2 is a plan view of the subject mounting bracket.
Figure 3:
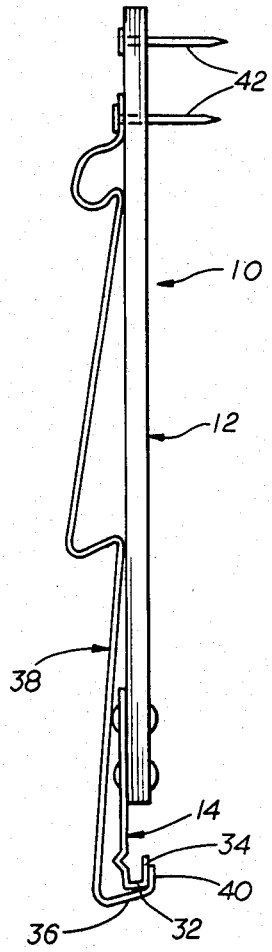
FIG. 3 is a side elevation, partly in section, showing the subject bracket in use mounting a section of panel, such as aluminum siding.

The mounting bracket 10 according to the present invention is formed of an elongated member 12 and a cross bar member 14 secured together by fixing means 16 into preferably a T shape. The elongated member 12 has a length 2–4 inches longer than the width of the panel to be mounted thereby. The member 12 is preferably an aluminum member having a cross section providing great structural rigidity. In the illustrated embodiment this cross section includes a central longitudinally extending rib 18 and overturned side flanges 20, 22. This member may be provided with an array of mounting apertures if desired. However, since the member will most likely be made of relatively light gauge aluminum, it could also be installed simply by driving conventional nails through it. The cross bar member 14 is likewise an aluminum member having a plate portion 24 having an angled offset gripping portion 26 extending along one marginal edge thereof. The gripping portion 26 can be provided with a strengthening rib 28 and is completed by a channel configuration 30 formed by integral side walls 32, 34 which are dimensioned according to the panel to be mounted thereby. The members 12, 14 are secured together by fixing means 16. While a T shape has been shown, other similar intersecting configurations at right, acute or abtuse angles could also be formed.

Preferably, the members and fixing means are of like material, such aluminum, so as to avoid problems of galvanic action initiating corrosion. Preferably both the members 12 and cross bar member 14 are extruded, but they could also be formed by a stamping, roll forming or other known techniques.

The preferred embodiment has also been described only with the reference to aluminum. It would, of course, be possible to use other materials, such as plastics, the primary requirement being sufficient rigidity and compatibility with the siding material.

The present invention can be utilized to install panels by either of two methods. In the first method, a plurality of brackets would be mounted spaced along a panel which is to form the first row. Each bracket would be mounted by inserting the channel configuration 30 in the bottom channel 36 of the panel 38 with the lip 40 of the panel engaging wall 32. The panel would then be positioned by a chalk mark or other indicia on the building and the brackets secured by means of nails 42. The second method would be preferred in cases where the structure is subject to periodic or sustained high winds or wind gusts which could tear the panels from the structure. In this instance, the brackets would be first fixed to the structure by nailing. The brackets would, of course, be aligned by a chalk mark or other indicia on the building to assure level installation. The panel would then be fitted to the cross member and secured at the top in conventional fashion. This would provide an assured fixed mounting. This method would be used when the first panel is to conceal any nonuniformity in the underlying structure.

While the present invention has, as its primary function, the installation of the first or bottom row of panels on the side of the building, it can likewise be used to secure a starter row on any portion of the building, including overhead areas such as soffets and/or ceilings. It also can be used for starter rows which are not horizontal in order to achieve a distinctive pattern.

The foregoing disclosure and description of the invention is illustrative and explanatory thereof, and various changes in the method steps as well as in the details of the illustrated apparatus may be made within the scope of the appended claims without departing from the spirit of the invention.

What is claimed is:

1. A bracket for installing pre-formed panels on a structure, each said panel having an inturned marginal portion forming a mounting channel, said bracket comprising:

an elongated member having a profiled cross section providing high rigidity, said elongated member having a length greater than the width of said panel to be mounted thereby; and a cross bar member secured to said elongated member in an intersecting configuration, said cross bar member having a cross section defining a marginal channel configuration adapted to grippingly engage said marginal mounting channel on said panel whereby said bracket can be installed to secure a first row of panels to a structure in a rigid and fixed manner.

2. A bracket according to claim 1 wherein bracket members are formed of material compatible with said panel whereby galvantic action is avoided.

3. A bracket according to claim 1 wherein said bracket members are formed of aluminum.

4. A bracket according to claim 1 wherein said bracket members are secured together by rivets.

5. A bracket according to claim 1 wherein said bracket members form a T-shaped configuration.

6. A bracket according to claim 1 wherein said elongated member has at least one longitudinally extending rib.

7. A bracket according to claim 1 wherein said cross bar member has at least one rib providing rigidity.

8. A system for installing panels on a structure comprising:

providing a plurality of bracket members each having fixedly attached, intersecting elongated and cross bar members, the elongated member being longer than the width of the panels and the cross bar being configured to engage in the panel in gripping fashion; and securing the brackets to the structure so as to fixedly position the panel thereon.

9. A system for installing panels on a structure comprising:

providing a plurality of brackets members each having fixedly attached, intersecting elongated and cross bar members, the elongated member being longer than the width of the panels and the cross bar being configured to engage in the panel in gripping fashion;

securing said brackets in said panel in spaced relation by said cross bar members; and positioning panel and bracket members on a structure and securing said bracket members thereto.

10. In combination with a preformed building panel having an enlongated shape and a transverse section including an inturned marginal mounting lip, a mounting bracket a plurality of which are utilized to mount a starting row of said panels, each said bracket comprising:

an elongated member having a profiled cross section providing high rigidity, said elongated member having a length greater than the width of said panel to be mounted thereby; and a cross bar member secured to said elongated member in a configuration in which the elongated axes of said members intersect, said cross bar member having a cross section defining a marginal channel configuration adapted to grippingly engage said marginal mounting channel on said panel whereby said bracket can be installed to secure a first row of panels to a structure in a rigid and fixed member.

* * * * *